US006908178B2

(12) United States Patent
Jeanmaire

(10) Patent No.: US 6,908,178 B2
(45) Date of Patent: Jun. 21, 2005

(54) CONTINUOUS INK JET COLOR PRINTING APPARATUS WITH RAPID INK SWITCHING

(75) Inventor: David L. Jeanmaire, Brockport, NY (US)

(73) Assignee: Eastman Kodak Company, Rochester, NY (US)

( * ) Notice: Subject to any disclaimer, the term of this patent is extended or adjusted under 35 U.S.C. 154(b) by 58 days.

(21) Appl. No.: 10/602,433

(22) Filed: Jun. 24, 2003

(65) Prior Publication Data

US 2004/0263585 A1 Dec. 30, 2004

(51) Int. Cl.[7] ..... B41J 2/07
(52) U.S. Cl. ..... 347/74; 347/73; 347/43; 347/98
(58) Field of Search ..... 347/73–83, 98, 347/21, 22

(56) References Cited

U.S. PATENT DOCUMENTS 3,709,432 A 1/1973 Robertson
4,672,432 A 6/1987 Sakurada et al.
4,811,035 A * 3/1989 Huliba et al. ..... 347/89
6,079,821 A 6/2000 Chwalek et al.
6,137,501 A * 10/2000 Wen et al. ..... 346/140.1
6,554,410 B2 4/2003 Jeanmaire et al.

* cited by examiner

*Primary Examiner*—Lamson Nguyen
(74) *Attorney, Agent, or Firm*—Milton S. Sales; Mark G. Bocchetti

(57) ABSTRACT

A print head provides for multi-level printing with colorants of different densities without print head replication. A continuous ink jet printer includes a plurality of ink sources; a print head connected to multiple ink sources; and apparatus adapted to selectively transfer ink from each of the connected sources to the print head or to block such transfer. The nozzles selectively create a streams of ink droplets having a plurality of volumes. The apparatus also includes a droplet deflector having a gas source to interact with the stream of ink droplets, thereby separating ink droplets into printing and non-printing paths. The apparatus includes a print heads which can be switched between "light" and "dark" ink sources. This allows multi-level printing, thus achieving higher print quality at the same resolution without incurring the costs associated with additional dedicated print heads.

16 Claims, 4 Drawing Sheets

CONTINUOUS INK JET COLOR PRINTING APPARATUS WITH RAPID INK SWITCHING

FIELD OF THE INVENTION

This invention relates generally to the field of digitally controlled printing devices, and in particular to continuous ink jet printers in which a liquid ink stream breaks into droplets, some of which are selectively deflected.

BACKGROUND OF THE INVENTION

Traditionally, digitally controlled color printing capability is accomplished by one of two technologies. Both require independent ink supplies for each of the colors of ink provided. Ink is fed through channels to a nozzle set from which droplets of ink are selectively ejected. Typically, each technology requires separate ink delivery systems for each ink color used in printing.

Conventional "drop-on-demand" ink jet printers utilize a pressurization actuator to produce the ink jet droplet at orifices of a print head. Typically, one of two types of actuators are used including heat actuators and piezoelectric actuators. With heat actuators, a heater, placed at a convenient location, heats the ink causing a quantity of ink to phase change into a gaseous steam bubble that raises the internal ink pressure sufficiently for an ink droplet to be expelled. With piezoelectric actuators, an electric field is applied to a piezoelectric material possessing properties that create a mechanical stress in the material causing an ink droplet to be expelled.

The second technology, commonly referred to as "continuous stream" or simply as "continuous" ink jet printing, uses a pressurized ink source which produces a continuous stream of ink droplets. Some continuous ink jet printers utilize electrostatic charging devices that are placed close to the point where a filament of working fluid breaks into individual ink droplets. The ink droplets are electrically charged and then directed to an appropriate location by deflection electrodes having a large potential difference. When no printing is desired, the ink droplets are deflected into an ink capturing mechanism (catcher, interceptor, gutter, etc.) and either recycled or discarded. When printing is desired, the ink droplets are not deflected and allowed to strike a print media. Alternatively, deflected ink droplets may be allowed to strike the print media, while non-deflected ink droplets are collected in the ink capturing mechanism.

U.S. Pat. No. 3,709,432, issued to Robertson on Jan. 9, 1973, discloses a method and apparatus for stimulating a filament of working fluid causing the working fluid to break up into uniformly spaced ink droplets through the use of transducers. The lengths of the filaments before they break up into ink droplets are regulated by controlling the stimulation energy supplied to the transducers, with high amplitude stimulation resulting in short filaments and low amplitudes resulting in long filaments. A flow of air is generated across the paths of the fluid at a point intermediate to the ends of the long and short filaments. The air flow affects the trajectories of the filaments before they break up into droplets more than it affects the trajectories of the ink droplets themselves. By controlling the lengths of the filaments, the trajectories of the ink droplets can be controlled, or switched from one path to another. As such, some ink droplets may be directed into a catcher while allowing other ink droplets to be applied to a receiving member.

U.S. Pat. No. 6,079,821, issued to Chwalek et al. on Jun. 27, 2000, discloses a continuous ink jet printer that uses actuation of asymmetric heaters to create individual ink droplets from a filament of working fluid and deflect thoses ink droplets. A print head includes a pressurized ink source and an asymmetric heater operable to form printed ink droplets and non-printed ink droplets. Printed ink droplets flow along a printed ink droplet path ultimately striking a print media, while non-printed ink droplets flow along a non-printed ink droplet path ultimately striking a catcher surface. Non-printed ink droplets are recycled or disposed of through an ink removal channel formed in the catcher. While this device is capable of high quality printing, it is limited to ink fluids which have a large viscosity change with temperature.

U.S. Pat. No. 6,554,410, which issued to Jeanmaire et al. on Apr. 29, 2003, and U.S. patent application Ser. No. 09/751,232, filed Dec. 28, 2000, disclose continuous-jet printing methods wherein nozzles with annular heaters are selectively actuated at a plurality of frequencies to create the stream of ink droplets having the plurality of volumes. A gas stream then separates droplets into printing and non-printing paths according to drop volume. Larger droplets are directed to a recording media, whereas smaller droplets are captured in a plenum and recycled.

For traditional color printing applications, three or four print heads are required (i.e., CMY or CMYK). The use of additional inks, for example, multiple concentrations of a colorant, can provide superior photographic reproduction as presented in U.S. Pat. No. 4,672,432 to Sakurada et al. in 1987. Six print heads were required, one for each of high density black, high density yellow, high density cyan, high density magenta, low density cyan and low density magenta. While this approach can improve the image quality for photographic printing, additional print heads significantly increase the cost of the apparatus.

SUMMARY OF THE INVENTION

It is an object of the present invention to provide an improvement to continuous ink jet printers of type described by Jeanmaire and Chwalek. The features of low-power and low-voltage print head operation are desirable to retain, while providing for multi-level printing with colorants of different densities without the complexity of print head replication.

In accordance with the present invention, a continuous ink jet printer includes a plurality of ink sources; a print head fluidly connected to multiple ink sources; and apparatus adapted to selectively transfer ink from each of the connected ink source to the print head or block such transfer.

BRIEF DESCRIPTION OF THE DRAWINGS

Other features and advantages of the present invention will become apparent from the following description of the preferred embodiments of the invention and the accompanying drawings, wherein.

DETAILED DESCRIPTION OF THE INVENTION

Figure 1:
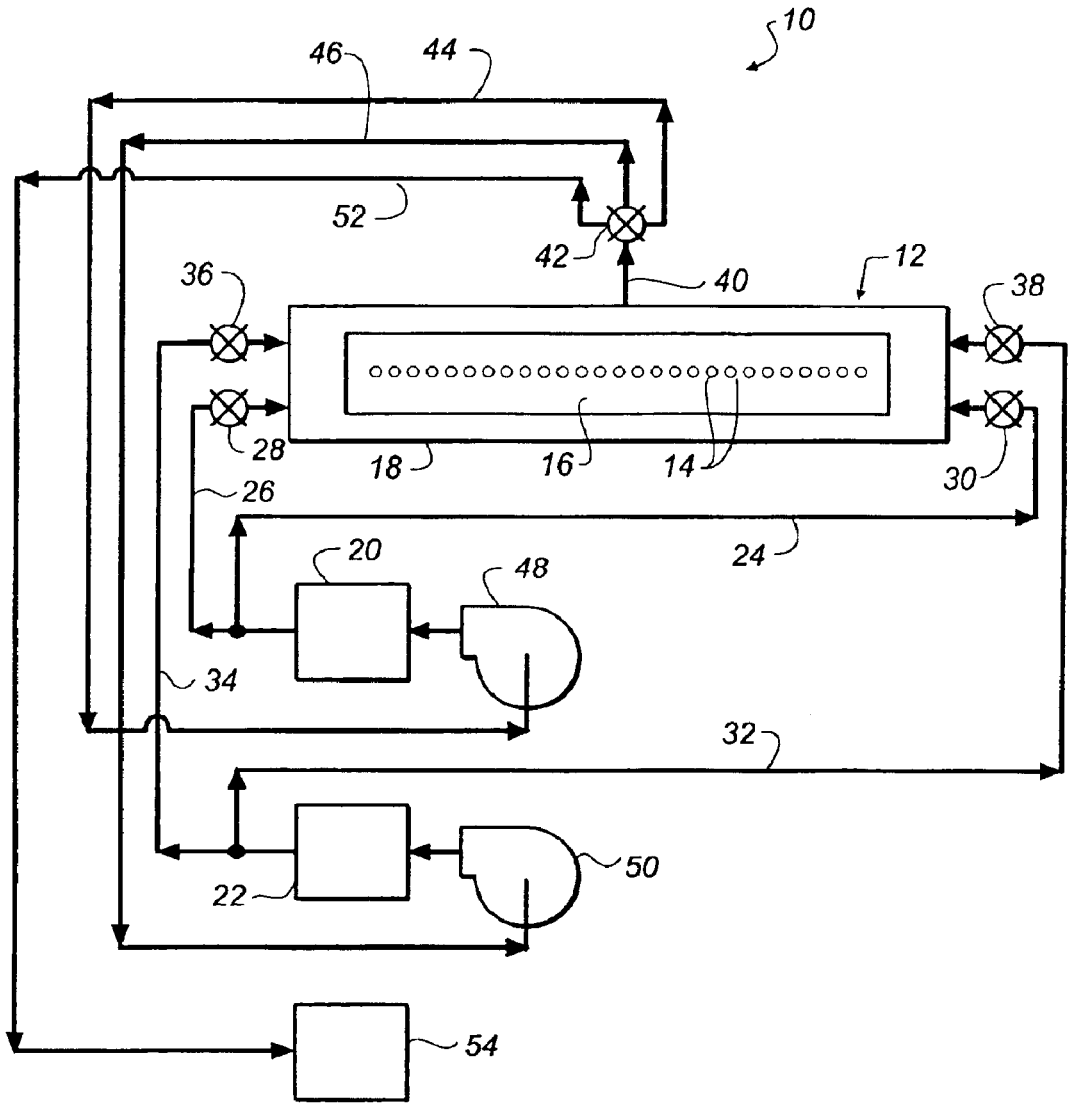
FIG. 1 is a schematic representation of an ink jet print head made in accordance with a preferred embodiment of the present invention and showing fluidic connections.

Referring to FIG. 1, an ink droplet forming mechanism 10 includes a print head 12 and associated fluidic connections. The print head consists of a row of nozzles 14 fabricated in a silicon die 16. Die 16 is bonded to manifold 18 which has an integral ink manifold to provide fluid communication to the nozzles. In this example, provision is made for switching between two inks having differing concentrations of colorant. The principle of this invention is not limited to two inks, and that switching between larger numbers of ink sources is clearly within the scope of this invention. The ink sources are reservoirs 20 and 22. Reservoir 20 contains a "dark" density ink, and reservoir 22 a "light" density ink. For printing with the dark ink, reservoir 20 is coupled to both ends of manifold 18 through fluid lines 24 and 26. Electromechanical solenoid valves 28 and 30 either permit or block pressurized ink from flowing into manifold 18. For printing with light ink, reservoir 22 is coupled to both ends of manifold 18 through fluid lines 32 and 34. Solenoid valves 36 and 38 control ink flow into manifold 18.

When manifold 18 is supplied with pressurized ink, a fraction of the ink flowing into manifold 18 is jetted from the nozzles in die 16. The balance of the ink flow is recirculated by exiting from the middle of manifold 18 into a recirculation line 40. A four-way valve 42 directs the ink back to the active ink source through either line 44 or 46. Dark ink flows into a circulation pump 48 which communicates with reservoir 20, and light ink flows into a circulation pump 50 which communicates with ink reservoir 22. Following each switching event between ink sources, valve 42 briefly connects recirculation line 40 to a line 52. This permits several seconds of rapid purging to occur in manifold 18 to shorten the conversion time between inks. Ink collected during the purging time flows via line 52 to a container 54, and is then periodically reprocessed for reuse. The ink in container 54 will be intermediate in colorant concentration between the light and dark ink in reservoirs 20 and 22. Generally, it is most convenient in the printer system to combine this ink with the light ink recovered from the ink catcher assembly (discussed in more detail later), whereby make-up solvent can be added to this ink to re-condition the ink to the light ink colorant concentration.

Figure 2:
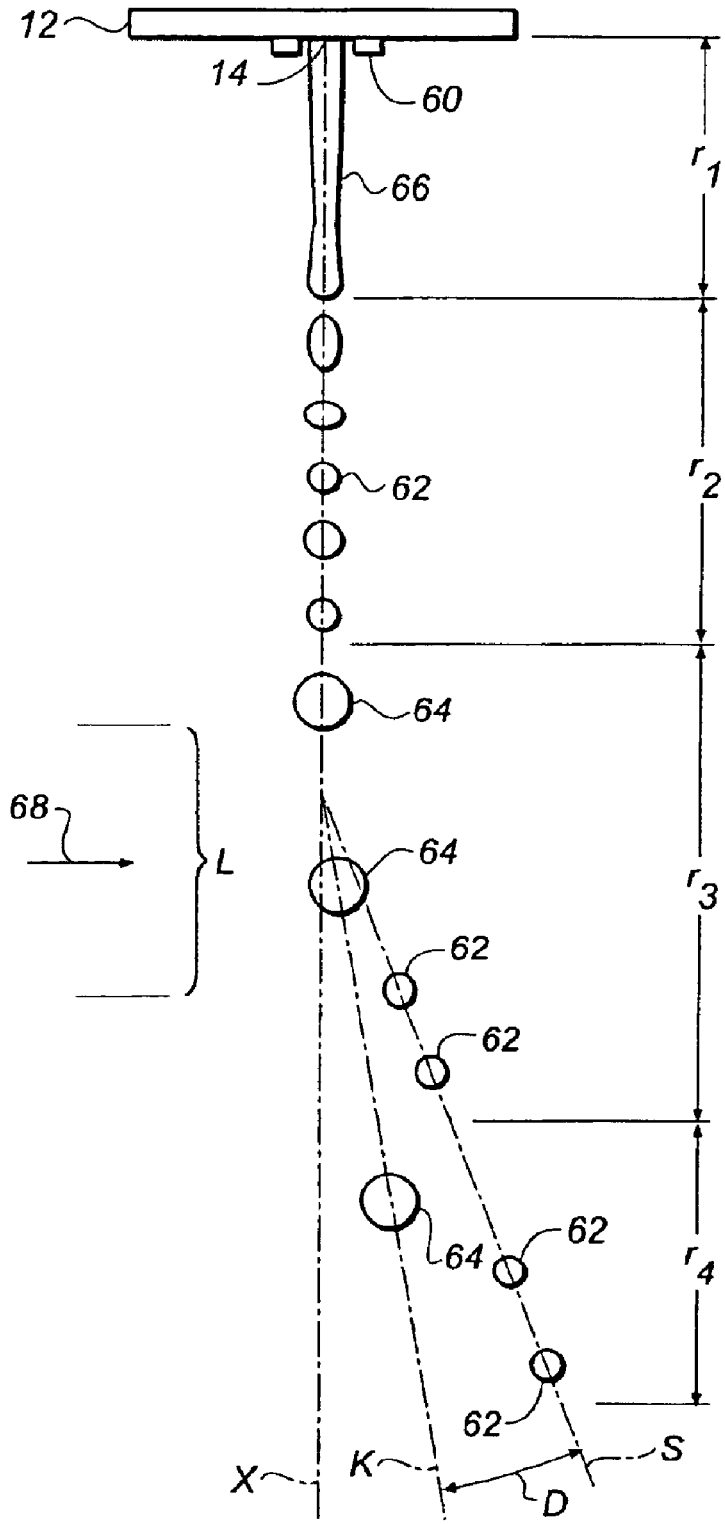
FIG. 2 is a side view of an ink jet print head and illustrating droplet separation.

FIG. 2 illustrates one form of continuous ink jet technology, and is included as background material. Drop volume can be controlled in a known manner by controlling the electrical waveform to a heater 60. In general, a rapid pulsing of heater 60 forms small ink droplets 62, while slower pulsing creates larger droplets 64. In the example presented here, small ink droplets 62 are to be used for marking on the image receiver, while larger droplets 64 are captured for ink recycling.

In the drop formation for each image pixel, a non-printing large drop 64 is always created, in addition to a variable number of small, printing droplets 62. All small, printing droplets 62 are the same volume, however the volume of the larger, non-printing droplets 64 varies depending on the number of small droplets 62 created in the pixel time interval, because the creation of small droplets takes mass away from the large drop during the pixel time interval P.

The operation of print head 20 in a manner such as to provide an image-wise modulation of drop volumes, as described above, is coupled with an gas-flow discriminator which separates droplets into printing or non-printing paths according to drop volume. Ink is ejected through nozzle 14 in print head 12, creating a filament 66 of working fluid moving substantially perpendicular to print head 12 along axis X. The physical region over which the filament of working fluid is intact is designated as $r_1$. Heater 60 is selectively activated at various frequencies according to image data, causing filament 66 of working fluid to break up into a stream of individual ink droplets. Coalescence of droplets often occurs in forming non-printing droplets 64. This region of jet break-up and drop coalescence is designated as $r_2$. Following region $r_2$, drop formation is complete in region $r_3$ and small, printing droplets and large, non-printing droplets are spatially separated. Beyond this region in $r_4$, aerodynamic effects can cause merging of adjacent small and large droplets, with concomitant loss of imaging information. A discrimination force 68 is provided by a gas flow perpendicular to an axis X. The force acts over a distance L, which is less than or equal to distance $r_3$. Large, non-printing droplets 64 have greater masses and more momentum than small volume droplets 62. As gas force 68 interacts with the stream of ink droplets, the individual ink droplets separate depending on individual volume and mass. Accordingly, the gas flow rate can be adjusted to produce a sufficient differentiation angle D in a small droplet path S from a large droplet path K, permitting small droplets 62 to strike print media while large, non-printing droplets 64 are captured by a ink guttering structure described below.

Figure 3:
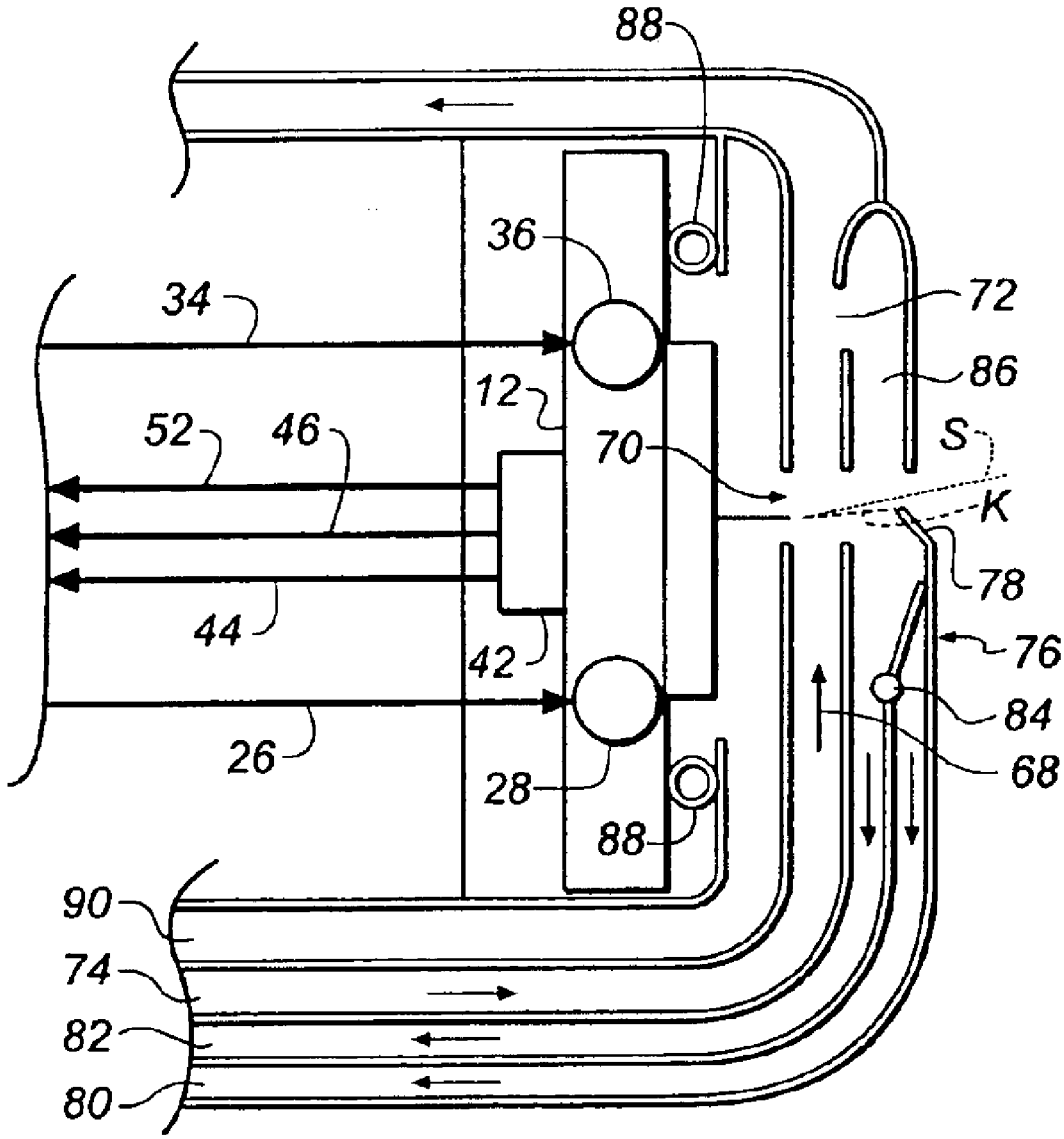
FIG. 3 is a cross-sectional view of an ink jet print head assembly made in accordance with a preferred embodiment of the present invention and highlighting droplet deflector and ink catcher assemblies.

A preferred embodiment of a print head assembly is shown in cross-sectional view in FIG. 3, where the droplet deflector and ink catcher elements are emphasized. Large volume ink droplets 64 and small volume ink droplets 62 are formed from ink ejected from print head 12 substantially along ejection paths K and S, respectively. A droplet deflector 70 contains an upper plenum 72 and a lower plenum 74 which facilitate a laminar flow of gas in droplet deflector 70. Pressurized air enters lower plenum 74 which is disposed opposite plenum 72 and promotes laminar gas flow while protecting the droplet stream moving along path X (FIG. 2) from external air disturbances. The application of force 68 due to gas flow separates the ink droplets into small-drop path S and large-drop path K.

An ink collection structure 76, disposed adjacent to lower plenum 74 near path X, intercepts path K of large droplets 64, while allowing small ink droplets 62 traveling along small droplet paths S to continue on to a recording media. Large, non-printing ink droplets 64 strike an ink catcher 78 in ink collection structure 76. Ink recovery conduits 80 and 82 return ink to separate recovery reservoirs (not shown). Negative pressure in conduits 80 and 82 facilitate the motion of recovered ink to the recovery reservoirs. The pressure reduction in conduits 80 and 82 is sufficient to draw in recovered ink, but is not large enough to cause significant air flow to substantially alter drop paths S. A valve 84 directs the flow of recovered ink into either conduit 80 or 82, depending upon the source ink jetted from print head 20.

A small portion of the gas flowing through upper plenum 72 is re-directed by a plenum 86 to the entrance of ink collection structure 76. The gas pressure in droplet deflector 70 is adjusted in combination with the design of plenums 74 and 72 so that the gas pressure in the print head assembly near ink catcher 78 is positive with respect to the ambient air pressure external to the print head assembly. Environmental dust and paper fibers are thusly inhibited from approaching and adhering to ink catcher 78 and are also excluded from entering ink recovery conduits 80 and 82.

An "O" ring 88 and a spill channel 90 provide a means to capture and recycle ink that comes from misdirected nozzles in print head 20 which fail to properly enter droplet deflector 70.

Figure 4:
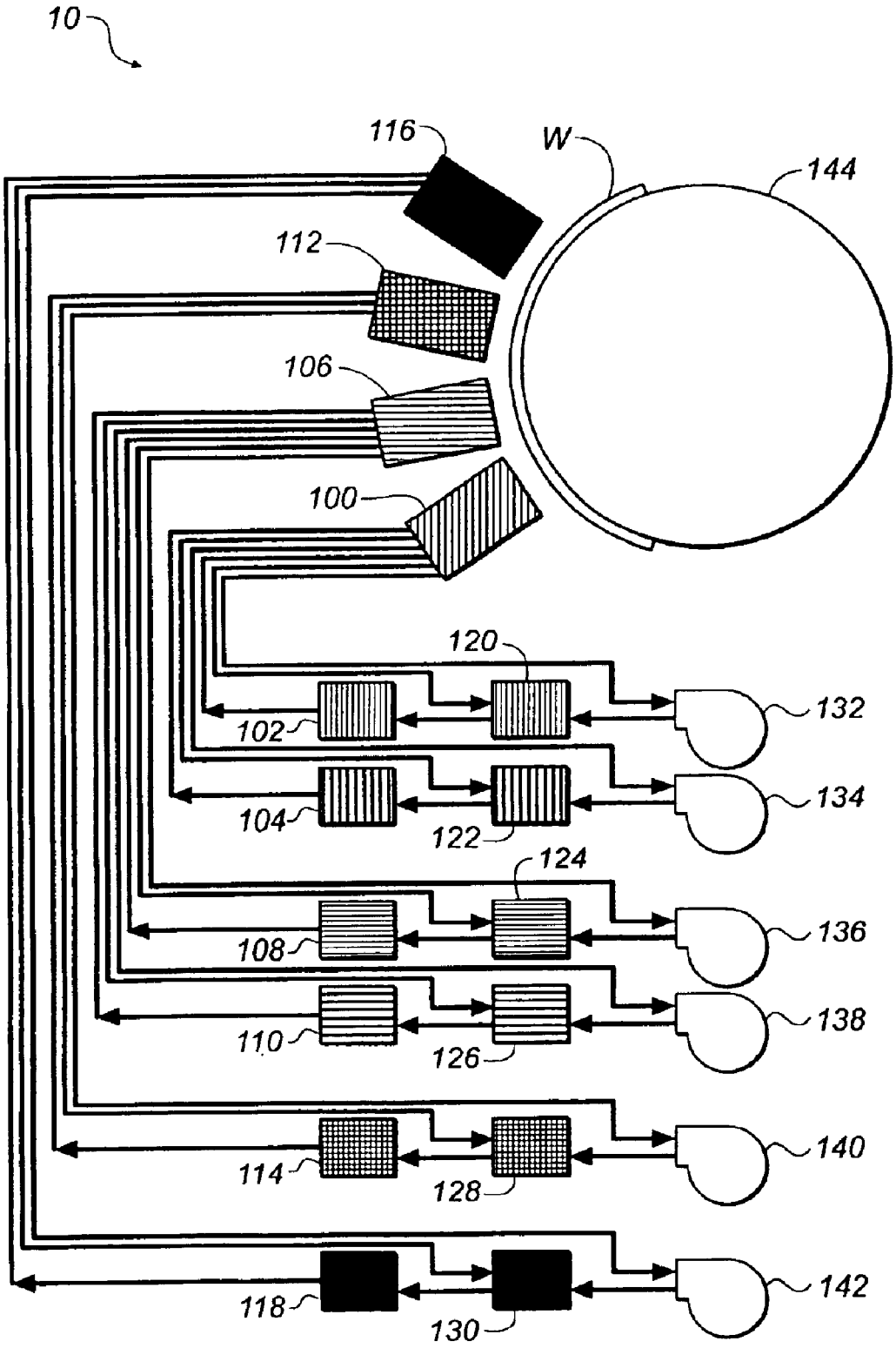
FIG. 4 is a schematic view of an ink jet printer made in accordance with a preferred embodiment of the present invention.

FIG. 4 is a schematic diagram illustrating a preferred embodiment of the ink fluidic system in a six-color printer. In this example, "light" and "dark" magenta inks and "light" and "dark" cyan inks are formulated with different concentrations of colorant. These inks are supplemented with a single yellow ink and a single black ink. Magenta inks are supplied to a print head assembly 100 from either a source reservoir 102 of "light" magenta ink or a source reservoir 104 of "dark" magenta ink, cyan inks are supplied to a print head assembly 106 from either a source reservoir 108 of "light" cyan ink or a source reservoir 110 of "dark" cyan ink, yellow ink is supplied from a source reservoir 114 to a print head assembly 112, and black ink is supplied to a print head assembly 116 from a source reservoir 118. Pressurized ink circulates through the print heads and back to appropriate ink mixing units 120, 122, 124, 126, 128 and 130 associated with the ink source reservoirs. Non-printing ink recovered from the ink catchers in the print head assemblies is directed into six circulation pumps 132, 134, 136, 138, 140 and 142. The function of the ink recycling pumping units is to filter out particulates and re-adjust the colorant concentrations to match that in the source reservoirs 102, 104, 108, 110, 114 and 118 respectively.

In operation, a recording media W is transported in a direction transverse to axis X by a print drum 144 in a known manner. Transport of recording media W is coordinated with movement of print mechanism 10 and the switching between "light" and "dark" inks in a known manner. Recording media W may be selected from a wide variety of materials including paper, vinyl, cloth, other fibrous materials, etc.

PARTS LIST

10 ink droplet forming mechanism
12 print head
14 nozzles
16 silicon die
18 manifold
20 dark ink reservoir
22 light ink reservoir
24 "dark" ink supply line
26 "dark" ink supply line
28 solenoid valve
30 solenoid valve
32 "light" ink supply line
34 "light" ink supply line
36 solenoid valve
38 solenoid valve
40 Recirculation line
42 four-way valve
44 line
46 line
48 circulation pump
50 circulation pump
52 line
54 container
60 heater
62 small drop
64 large drop
66 filament
68 discrimination force
70 deflector
72 upper plenum
74 lower plenum
76 collection structure
78 catcher
80 conduit
82 conduit
84 valve
plenum
88 O ring
90 spill channel
100 magenta print head assembly
102 "light" magenta ink source reservoir
104 "dark" magenta ink source reservoir
106 cyan print head assembly
108 "light" cyan ink source reservoir
110 "dark" cyan ink source reservoir
112 yellow print head assembly
114 yellow ink source reservoir
116 black print head assembly
118 black ink source reservoir
120 "light" magenta ink mixing unit
122 "dark" magenta ink mixing unit
124 "light" cyan ink mixing unit
126 "dark" cyan ink mixing unit
128 yellow ink mixing unit
130 black ink mixing unit
132 "light" magenta ink circulation pump
134 "dark" magenta ink circulation pump
136 "light" cyan ink circulation pump
138 "dark" cyan ink circulation pump
140 yellow ink circulation pump
142 black ink circulating pump
144 print drum

What is claimed is:

1. A continuous ink jet printer for delivering droplets of ink; the printer comprising:

a print head having a manifold;

a plurality of nozzle openings associated with the manifold through which opening ink droplets are delivered from the manifold;

a plurality of sources of liquid ink, each source containing liquid ink of a different optical characteristic; and a flow controller selectively communicating the sources of liquid ink with the manifold, whereby ink droplets of selectable optical characteristic are prepared in the manifold for continuous delivery of ink droplets from all of the plurality of nozzle openings, all of the ink droplets having the same optical characteristics as the liquid in the manifold.

2. A continuous ink jet printer as set forth in claim 1, wherein the plurality of sources contain inks of different colors, whereby ink droplets of selectable color are prepared in the manifold for delivery from the nozzle opening.

3. A continuous ink jet printer as set forth in claim 1, wherein the plurality of sources contain inks of different density, whereby ink droplets of selectable density are prepared in the manifold for delivery from the nozzle opening.

4. A continuous ink jet printer as set forth in claim 1, wherein the flow controller comprises a pump.

5. A continuous ink jet printer as set forth in claim 1 wherein:

one of the plurality of sources of liquid ink contains colorless liquid ink communicating with the manifold; and the flow controller is further adapted to meter colorless ink into the manifold after a droplet is delivered from the nozzle opening to thereby dilute color ink remaining in the manifold sufficiently such that a next desired optical characteristic can be attained by adding ink of appropriate optical characteristic to the manifold.

6. A continuous ink jet printer as set forth in claim 1, wherein the plurality of sources contain inks of different colors, whereby ink droplets of selectable color are prepared in the manifold for delivery from the nozzle opening.

7. A continuous ink jet printer as set forth in claim 1, wherein the plurality of sources contain inks of different density, whereby ink droplets of selectable density are prepared in the manifold for delivery from the nozzle opening.

8. A continuous ink jet printer for delivering droplets of ink; the printer comprising:

a print head having a manifold;

a nozzle opening associated with the manifold through which opening ink droplets are delivered from the manifold;

a plurality of sources of liquid ink, each source containing liquid ink of a different optical characteristic; and a flow controller selectively communicating the sources of liquid ink with the manifold, whereby ink droplets of selectable optical characteristic are prepared in the manifold for delivery from the nozzle opening, wherein the flow controller comprises a pressurized source and a valve.

9. A continuous ink jet printer as set forth in claim 8, wherein the plurality of sources contain inks of different colors, whereby ink droplets of selectable color are prepared in the manifold for delivery from the nozzle opening.

10. A Continuous ink jet printer as set forth in claim 8, wherein the plurality of sources contain inks of different density, whereby ink droplets of selectable density are prepared in the manifold for delivery from the nozzle opening.

11. A continuous ink jet printer as set forth in claim 8, wherein:

one of the plurality of sources of liquid ink contains colorless liquid ink communicating with the manifold; and the flow controller is further adapted to meter colorless ink into the manifold after a droplet is delivered from the nozzle opening to thereby dilute color ink remaining in the manifold sufficiently such that a next desired optical characteristic can be attained by adding ink of appropriate optical characteristic to the manifold.

12. A continuous ink jet printer as set forth in claim 8, wherein the plurality of sources contain inks of different colors, whereby ink droplets of selectable color are prepared in the manifold for delivery from the nozzle opening.

13. A continuous ink jet printer as set forth in claim 8, wherein the plurality of sources contain inks of different density, whereby ink droplets of selectable density are prepared in the manifold for delivery from the nozzle opening.

14. A continuous ink jet printer for delivering droplets of ink; the printer comprising:

a print head having a manifold;

a nozzle opening associated with the manifold through which droplets are delivered from the manifold;

a plurality of sources of liquid ink, each source containing liquid ink of a different optical characteristic; and a flow controller selectively communicating the sources of liquid ink with the manifold, whereby ink droplets of selectable optical characteristic are prepared in the manifold for delivery from the nozzle opening, wherein:

one of the plurality of sources of liquid ink contains colorless liquid ink communicating with the manifold; and the flow controller is further adapted to meter colorless ink into the manifold after a droplet is delivered from the nozzle opening to thereby dilute color ink remaining in the manifold sufficiently such that a next desired optical characteristic can be attained by adding ink of appropriate optical characteristic to the manifold.

15. A continuous ink jet printer as set forth in claim 14, wherein the plurality of sources contain inks of different colors, whereby ink droplets of selectable color are prepared in the manifold for delivery from the nozzle opening.

16. A continuous ink jet printer as set forth in claim 14, wherein the plurality of sources contain inks of different density, whereby ink droplets of selectable density are prepared in the manifold for delivery from the nozzle opening.

* * * * *